US006536586B2

(12) United States Patent
Nakao et al.

(10) Patent No.: US 6,536,586 B2
(45) Date of Patent: Mar. 25, 2003

(54) COMBINATION VESSEL OF A CAP TYPE SEALING TOOL HAVING TAMPER FUNCTION AND A BOTTLE PORTION

(75) Inventors: Masaharu Nakao, Ibaraki (JP); Yukihiro Ogawa, Ibaraki (JP); Atsuhiro Doke, Kasugai (JP); Yasuhiro Yokoyama, Kasugai (JP); Seiichi Ichikawa, Kasugai (JP)

(73) Assignees: Taisei Kako Co., Ltd., Osaka (JP); Menicon Co., Ltd., Aichi (JP)

( * ) Notice: Subject to any disclaimer, the term of this patent is extended or adjusted under 35 U.S.C. 154(b) by 0 days.

(21) Appl. No.: 09/774,579

(22) Filed: Feb. 1, 2001

(65) Prior Publication Data

US 2001/0019022 A1 Sep. 6, 2001

(30) Foreign Application Priority Data

Feb. 1, 2000 (JP) ..... 2000-028911

(51) Int. Cl.[7] ..... A45C 11/04
(52) U.S. Cl. ..... 206/5.1; 215/252; 215/258
(58) Field of Search ..... 206/5.1; 215/252, 215/258, 250, 272, 317, 318

(56) References Cited

U.S. PATENT DOCUMENTS 4,529,096 A * 7/1985 Chartier et al. ..... 215/250
4,721,218 A * 1/1988 Gregory et al. ..... 215/252
4,830,208 A * 5/1989 Osting et al. ..... 215/252
5,056,675 A * 10/1991 Julian ..... 215/252
5,373,954 A * 12/1994 Julian ..... 215/252
5,648,037 A * 7/1997 Franchet et al. ..... 215/252
5,893,474 A * 4/1999 Herrmann et al. ..... 215/252
6,085,921 A * 7/2000 Brown ..... 215/252

FOREIGN PATENT DOCUMENTS

JP 56-131362 10/1980
JP 7-21556 4/1995
JP 9-58720 3/1997

* cited by examiner

*Primary Examiner*—Shian Luong
(74) *Attorney, Agent, or Firm*—Wenderoth, Lind & Ponack, L.L.P.

(57) ABSTRACT

A combination vessel is capable of carrying out temporary fastening while always bringing down a ring portion subsequently to breakage of a bridge part during an opening operation. A cap portion and a ring portion of a cap type sealing tool are coupled to each other through a bridge part. Through breakage of the bridge part during opening of the cap portion, the ring portion is pulled down while a sliding protrusion on an internal wall in a lower stage area of the ring portion always contacts by pressure an upward spread zone on an external wall of a neck zone of a bottle portion. In addition, vertical convexities to block an opening turn of the cap portion provided on an inner periphery of the ring portion, and vertical convexities to block the opening turn provided on an external wall of a neck zone of the bottle portion, do not prevent attachment of the cap type sealing tool, but do prevent accompanied rotation of the ring portion during the opening of the cap portion to thereby allow breaking of the bridge part. At least one higher vertical convexity is provided as one of the vertical convexities provided on the inner periphery of the ring portion. Consequently, it is possible to prevent the ring portion from an erratic opening. Furthermore, the bridge part is not broken during temporary mounting of the cap type sealing tool and a subsequent opening thereof.

19 Claims, 5 Drawing Sheets

COMBINATION VESSEL OF A CAP TYPE SEALING TOOL HAVING TAMPER FUNCTION AND A BOTTLE PORTION

BACKGROUND OF THE INVENTION

1. Field of the Invention

The present invention relates to a combination vessel of a cap type sealing tool and a bottle portion having a specifically shaped external wall, and a combination vessel of a cap type sealing tool including a cap portion and a ring portion, and a bottle portion. More particularly, the present invention relates to a combination vessel of a cap type sealing tool in which a lower surface of the cap portion and an upper surface of the ring portion are coupled to each other through a plurality of bridge parts which can easily be broken, and a bottle portion having a specifically shaped external wall. Each bridge part couples the lower surface of the cap portion to the upper surface of the ring portion, and is broken via rotation of the cap portion in a cap portion opening (unsealing) direction. The ring portion is always slid downwardly while a sliding protrusion provided in a lower stage area of an internal wall contacts, by pressure, an upward spread zone formed on an external wall of a neck area of the bottle portion.

In addition, the present invention relates to a combination vessel of a cap type sealing tool and a bottle portion without any possibility that a contact lens dropped from holding structure by mistake might adhere to a bottom surface of a bottle area, because of formation of specific concavo-convex shapes on a bottom of an internal wall of the bottle portion. A suspending member extends from a bottom (back) surface of a top plate part of the cap portion, and a mutual relationship among vertical convexities to block an opening turn (e.g. non-return type vertical protrusions, non-return type vertical trenches, non-return type ratchet) is established to realize a "temporary mounting" state in order to prevent the holding structure, for maintaining the contact lens or the like, from being deformed. In addition, the "temporary mounting" state is very preferable when supplying the vessel to customers who are to supply contents at their end, wherein a vessel in the "temporary mounting" state means that the vessel can be opened without breakage of the bridge parts unless the cap portion is further rotated.

Furthermore, the present invention relates to a combination vessel of a cap type sealing tool and a bottle portion which can continuously achieve a cap portion closing state, from which the cap portion is capable of easily being opened while also maintaining airtightness of a filled solution when the cap type sealing tool is turned in a cap portion closing direction beyond the temporary mounting state.

2. Description of the Related Art

A distribution bottle portion (which is used on a distribution route) of an RGP contact lens to be used as a bottle portion constituting a combination vessel according to the present invention is a combination vessel mainly constituted by three members, namely, a cap portion, a suspending tool (holding member) extending from a lower surface of a top plate part of the cap portion, and a bottle portion.

A conventional coupling seal tool (virgin cap) of this kind is a structure obtained by coupling a cap portion, screwed to an outer periphery of a neck area of a bottle portion, and a ring portion through a plurality of thin bridges extended from a lower end surface of the cap portion. When the cap portion is usually turned in a closing direction during cap portion opening, the following non-return (check) function results. Specifically, a projection, to block an opening turn of the cap portion (downward projection), provided on the lower end surface of the cap portion is engaged with a projection, to block the opening turn of the cap portion (upward projection), provided on the upper surface of the ring portion to turn the ring portion. Also, a vertical projection, to block an opening turn of the cap portion (ratchet), provided on an internal wall surface of the ring portion is engaged with a vertical projection (ratchet) provided on an external wall surface of a neck area of the bottle portion to block rotation of the ring portion.

Consequently, in addition to the function to block the opening turn of the cap portion, the bridge is broken by a downward pressing force (push-down force) applied when the lower projection is positioned over the upper projection positioned on the right side thereof so that the ring portion is brought down and only the separated cap portion can be turned. There has been an advantage in that it is possible to determine whether a cap portion has already been opened or not by looking at the bridge and determining if it has been broken.

The foregoing proposals of this kind include the following examples. Japanese Laid-Open Utility Model Publication No. 7-21556 (1995):

This proposal relates to a "prevention against an incorrect opening of cap" 1 formed by a bottomed cylindrical cap body 2 and a ring 3 adjacent to a lower end surface thereof. A sawtooth type pressing projection 7 is provided extending downwardly at two portions on the lower end surface, while a sawtooth pressure receiving projection 10 is provided extending upwardly from an upper surface of the ring 3. Next, the lower end surface of the cap body 2 is coupled to the upper surface of the ring 3 through several coupling pieces 4.

Furthermore, the sawtooth type pressing projection 7 is engaged with a projection of the ring 3 when a screw, provided on an internal wall of the cap body 2, is turned in a closing direction, and is not engaged with the projection of the ring 3 when the cap 2 is turned in an opening direction. In addition, eight vertical convexities 13 are provided extending inwardly from an inner periphery of a small diameter portion 3*a* of the ring 3. The vertical convexities 13 are not engaged with a sawtooth type vertical projection 25 provided on an external wall of a bottle member 20 when the cap 2 is turned in a closing direction, and are engaged with the sawtooth type vertical projection 25 when the cap 2 is turned in an opening direction.

Accordingly, when the cap 2 is once turned slightly in the closing direction, it is stopped in such a stage that a vertical convexity 13 provided on the internal wall thereof is positioned over the vertical projection 25 provided on the external wall of the bottle member 20, and is then turned in an opening direction such that the ring 3 positioned in a lower stage is turned together in the opening direction. As a result, the cap 1 can be removed from a neck portion of the bottle member 20 so that a bottle can be opened.

Referring to normal downward movement and predetermined position, fixation of ring portion 12 after opening of the bottle with such a structure so that the cap 1, to be part of the combination vessel according to the present invention, is mounted on an upward spread zone of the bottle member 20; however, a prevention system for preventing any incorrect opening of the cap 1 has been neither disclosed nor suggested. In other words, it is necessary to provide a press-interposing function through formation of a taper area (provision of a sliding protrusion 12*uc* or the like) in a lower stage of an internal wall of ring portion 12, and to carry out cooperation thereof with an upward spread (downward taper) area provided on an external wall of a neck area 2*m* on the bottle portion side in order to achieve normal downward movement of the ring portion 12 after bridge part 13 is broken according to the present invention. However, this aspect has been neither disclosed nor suggested in Japanese Laid-Open Utility Model Publication No. 7-21556 (1195).

Japanese Laid-Open Patent Publication No. 9-58720 (1997):

This proposal provides an improvement in a bottle member (which will be referred to as a "bottle") 1. The bottle member 1 has a thread 2 protruded only in an upper stage portion of an external wall of a neck area thereof. A middle stage portion of the external wall is smooth, a lower stage portion of the external wall is provided with a plurality of sawtooth and upwardly spread vertical projections 3, and a lower end of the neck area is provided with a flange-shaped projection 4.

It is supposed that the bottle 1 is to be used in a combination vessel with a separation type cap 5 having a specific structure. The separation type cap 5 to be used in a combination vessel with the bottle 1 has such a structure that a break ring 52 is coupled through several bridges 7 which are spaced from a lower end surface of a cap body 51 via space 6.

When the cap body 51 is turned rightwardly, a stopper 8*a* protruded downwardly from a lower end surface of the cap body 51, and a stopper 8*b* protruded upwardly from an upper surface of the break ring 52, are engaged with each other to maintain the bridges 7. When the cap body 51 is turned leftwardly (in a reverse spiral direction), both stoppers 8*a* and 8*b* are not engaged with each other and the cap portion 51 is independently turned to break the bridges 7.

The following engagement is also related to the breakage of the bridges 7. The following engagement implies that several projections 9 are provided to extend centrally from an internal wall of the break ring 52, and are engaged in a direction of specific turn with the sawtooth type projections 3 provided in the lower stage of the external wall of the neck area in the bottle member 1, so that turn of the break ring 52 is blocked. The direction of the specific turn indicates that the cap 5 is turned leftwardly (in an opening direction) and can be engaged with a projection 9 provided on an internal wall of the break ring 52, thereby blocking the leftward turning.

The above-mentioned Japanese Laid-Open Patent Publication No. 9-58720 (1997) has neither disclosed nor suggested a mechanism for producing a function of always pulling a ring potion 12 downwardly, after breakage of a bridge part 13 caused by an opening turn, for a combination vessel of the present invention. More specifically, it is necessary to perform a press interposing function through formation of a taper area (the provision of the sliding protrusion 12*uc* or the like) in a lower stage of an internal wall of the ring portion 12, and to carry out cooperation thereof with a formation of an upward spread zone (lower tapered area) on an external wall of a neck area 2*m* on a bottle portion 2 in order to always achieve downward movement of the ring portion 12 after breakage of the bridge part 13 in the present invention. However, Japanese Laid-Open Patent Publication No. 9-58720 (1997) neither discloses nor suggests this aspect.

In any one of the conventional coupled sealing tools described above, a ring is fitted externally in a neck area of a bottle after a cap is removed during cap opening, and is hardly removed erratically. More specifically, since the ring is hardly removed by itself from an outer periphery of the neck area of the bottle portion, it is often left alone. However, the left alone ring is erratically apt to drop from the neck area while an operation for pouring contents from the bottle portion is repeated. As a result, there has been caused an unfavorable contamination or scattering while the contents are thus poured out. In the case in which the contents are chemicals, foods, seasonings, beverages or the like, the contamination or the like is serious.

Considering the above-mentioned situations, the present invention has been completed and is intended for utilizing free rotation of a cap portion (rotation separate from that of a ring portion) during opening of the cap portion as is necessary for breakage of a bridge part caused by prevention of an accompanied turn of the ring portion, a subsequent pull-down of the ring portion and the like. More specifically, the present invention is intended for blocking the accompanied turn of the ring portion to be caused by rotation of the cap portion during opening of the cap portion, breaking the bridge part coupling the cap portion to the ring portion, always pulling down a separated ring portion along an upward spread zone of a neck area of a bottle portion, and finally fixing the ring portion to a lower end of the upward spread zone. The present invention employs such a structure wherein a sliding protrusion centrally extends from an internal wall in a lower stage area of the ring portion as structure for always carrying out the pull-down action for the ring portion, and utilizes elasticity of the ring portion to always slide it downwardly while pressing against the upward spread zone of the external wall of the neck area in the bottle portion.

Moreover, Japanese Laid-Open Utility Model Publication No. 56-131362 (1981) discloses a commercial combination vessel comprising a bottle portion for a contact lens to be used for a combination vessel according to the present invention. The commercial combination vessel is used after a contact lens is accommodated and sterilized in order to protect the contact lens from contamination by microorganisms or the like for longtime preservation. In this case, examples of a sterilizing method include high pressure steam sterilization, EOG (ethylene oxide gas) sterilization, high energy ray(beam) sterilization which uses electron beams (cathode rays) or gamma rays, and the like.

However, the electron beam sterilization has a problem of deterioration of material of the bottle portion, and the EOG sterilization tends to be avoided worldwide. Therefore, it has been eagerly desired that a bottle portion which is susceptible to the high pressure steam sterilization is to be employed so that the high pressure steam sterilization can be used as an inexpensive and safe sterilizing procedure. However, selection of materials which can be used for high pressure steam sterilization has been limited. In addition, although a soft material is preferable for a material of a suspending tool in the bottle portion, such soft material is too easily deformed by high pressure steam sterilization. Therefore, desired is a combination vessel that comprises a cap type sealing tool which can be temporarily mounted with a bottle portion to be subjected to high pressure steam sterilization.

As another problem, if an internal annular portion suspended from a bottom surface of a top plate part on an inside of a cylindrical portion of the cap portion is pressed into a mouth of a bottle portion by an opening turn in order to enhance airtightness in the bottle portion, the airtightness can be enhanced but a torque required for opening the cap portion is also increased. As a result, there is a drawback in that the cap portion cannot be opened easily. This drawback is particularly serious for a user having some handicap with regard to functioning of hands or fingers.

As a further problem, when a small-sized object, which is accommodated in the bottle portion or is being processed in the bottle portion, for example a contact lens or the like, is dropped into a bottom area of the bottle portion by mistake, a flat face on a surface of the contact lens often sticks to and comes into close contact with the bottom area of the bottle portion. Therefore, the lens cannot easily be removed. Such a situation has resulted in some cases.

SUMMARY OF THE INVENTION

The present invention can exert expected effects by employing at least one of the following aspects.

1) A first aspect of the present invention is directed to a combination vessel comprising a cap type sealing tool formed by a cap portion having a bottomed cylindrical shape and a ring portion coupled to a lower end surface of the cap portion so as to be easily separated therefrom, and a bottle portion including an upward spread zone provided on an external wall of a neck area. At least two bridge parts to be easily broken are coupled to, and positioned in a gap between, the lower end surface of the cap portion and an upper surface of the ring portion. When turning is carried out in a direction to close the cap portion, opening turn blocking convexities (projections), extending inwardly from an internal wall of the ring portion, and vertical convexities, to block a cap portion opening turn, extending outwardly from an external wall of the bottle portion engage one another. At least one of the convexities to block the opening turn of the cap portion provided on the external wall of the bottle portion is a high vertical convexity. The ring portion is pulled down while a sliding protrusion provided on an internal wall in a lower stage area of the ring portion always contacts, by pressure, an upward spread zone of the neck area of the bottle portion simultaneously with or subsequently to breakage of the bridge parts coupling the lower end surface of the cap portion to the upper surface of the ring portion.

2) A second aspect of the present invention is directed to a combination vessel comprising the cap type sealing tool and the bottle portion according to the first aspect of the present invention, wherein the ring portion has a ratio of an inside diameter, of a circle connecting edge line portions of a plurality of sliding protrusions extending centrally from an internal wall in a lower stage area of the ring portion, to an outside diameter, of an external wall of the neck area of the bottle portion, set to 0.85 to less than 1.0. And, the ring portion is pulled down while always pressing against the upward spread zone of the external wall of the bottle portion.

3) A third aspect of the present invention is directed to the combination vessel comprising the cap type sealing tool and the bottle portion according to the first or second aspects of the present invention, wherein the sliding protrusions extending centrally from the internal wall in the lower stage area of the ring portion each have a shape selected from a nearly dot-like protrusion and a nearly straight convex, and have a cross-sectional shape slightly rounded at sliding surfaces thereof and selected from at least one of a nearly triangular shape, a nearly tapered trapezoidal shape, a nearly semicircular shape and a nearly mushroom shape.

4) A fourth aspect of the present invention is directed to a combination vessel comprising the cap type sealing tool and the bottle portion according to any one of the first to third aspects of the present invention, wherein agradient of the upward spread zone formed on the external wall of the neck area of the bottle portion is set to 0.15 to 1.4, which is expressed in the smallest space between end faces of the upward spread zone (an outside diameter of an upper end face and an outside diameter of a lower end surface in the upward spread zone).

5) A fifth aspect of the present invention is directed to a combination vessel comprising the cap type sealing tool and the bottle portion according to any one of the first to fourth aspects of the present invention, wherein when turning is carried out in a direction to close a cap portion such that the convexities to block an opening turn of the cap portion, extending inwardly from the internal wall of the ring portion, and the vertical convexities, to block an opening turn of the cap portion, are engaged with each other, a mutual relationship of the engagement is established whereby a temporary mounting state can be realized by blocking the opening turn just at the time when a convexity to block an opening turn of the cap portion is positioned over a first of the vertical convexities.

6) A sixth aspect of the present invention is directed to a combination vessel comprising the cap type sealing tool and the bottle portion according to any one of the first to fourth aspects of the present invention, wherein when turning is carried out in a direction to close a cap portion such that the convexities to block an opening turn of the cap portion, extending inwardly from the internal wall of the ring portion, and the vertical convexities, to block of an opening turn of the cap portion of the bottle portion, are engaged with each other, a part, to block rotation as soon as possible after a convexity to block an opening turn of the cap portion is positioned over one of the vertical convexities, is provided in such a position as to have a rotational angle of up to 15 degrees with respect to a center of the cap portion after a final rotation, thereby preventing overfastening.

7) A seventh aspect of the present invention is directed to a combination vessel comprising the cap type sealing tool and the bottle portion according to any one of the first to sixth aspects of the present invention, wherein an internal annular portion projecting from a slightly inside portion, relative to a peripheral edge, of a bottom surface of a top plate part of the cap portion is pressed into an opening of the bottle portion upon rotation to maintain airtightness in the bottle portion. An outside diameter reducing range of the internal annular portion, which is generated by the pressing, is 0.5 mm or less with respect to an outside diameter of 20 mm.

8) An eighth aspect of the present invention is directed to a combination vessel comprising the cap type sealing tool and the bottle portion according to any one of the first to seventh aspects of the present invention, wherein at least one of the vertical convexities to block an opening turn of the cap portion provided on the external wall of the bottle portion is a high vertical convexity.

9) A ninth aspect of the present invention is directed to a combination vessel comprising the cap type sealing tool and the bottle portion according to the eighth aspect of the present invention, wherein a height degree (R %) of the high vertical convexity is 10 to 45%, and is expressed by an equation of $R=100\times(Lt-Ls)/Ls$, with a length of the high vertical convexity being represented by Lt and a length of an ordinary vertical convexity being represented by Ls.

10) A tenth aspect of the present invention is directed to a combination vessel comprising the cap type sealing tool and the bottle portion according to any one of the first to seventh aspects of the present invention, wherein a plurality of concavo-convexities are present in a bottom area of the bottle portion, with a top spacing therebetween being 15 to 90% of an outside diameter of a contact lens, and with a difference in height therebetween being at least 5% of a thickness at a nearly central position of the contact lens.

11) An eleventh aspect of the present invention is directed to a combination vessel including a cap type sealing tool formed by a cap portion having a bottomed cylindrical part and a ring portion coupled to a lower end surface of the cap portion so as to be easily removed therefrom, wherein the cap type sealing tool can be turned in an opening direction even when it has been temporarily mounted to a bottle portion and positioned over a first vertical convexity on an external wall of a neck zone of the bottle portion, so as to remove the cap type sealing tool from the bottle portion to feed contents into the bottle portion.

By using the combination vessel comprising the cap type sealing tool with the bottle portion according to the present invention, the following various effects can be realized.

(1) Engagement between the vertical convexities on the internal wall surface of the ring portion and the vertical convexities on the external wall of the bottle portion, is caused via a leftward turn (a turn to open) of the cap portion so that an accompanied turn of the ring portion is blocked. On the other hand, the cap portion is turned as it is so that the bridge parts are broken. As a result, the ring portion is pulled down to the upward spread zone of the external wall of the bottle portion while always contacting by pressure the sliding protrusions provided axially in the lower stage of the internal wall.

Consequently, the ring portion finally reaches the lower end of the upward spread zone and is fixed thereat.

(2) By viewing the state of the bridge parts, it is apparently clear to determine whether the cap portion is opened or not.

The above and further purposes and features of the invention will be more fully apparent from the following detailed description with accompanied drawings.

(3) The cap type sealing tool can be turned in the opening direction even when it has been temporarily mounted to the bottle portion in a stage where a vertical convexity on the inner surface of the ring portion is positioned over a first vertical convexity on the external wall of the neck zone of the bottle portion so as to remove the cap type sealing tool from the bottle portion in order to feed contents into the bottle portion.

BRIEF DESCRIPTION OF THE DRAWINGS

FIGS. 1(A) and 1(B) show a first aspect of the invention, wherein FIG. 1A is a schematic view showing a state in which a cap type sealing tool constituting part of a combination vessel is mounted on a bottle portion constituting another part of the combination vessel, and FIG. 1B is a schematic partially enlarged view showing an engagement between a cap portion and a ring portion, FIGS. 3(A)–3(C) show a second aspect of the invention, wherein FIG. 3A is a schematic longitudinal sectional view showing a cap type sealing tool constituting a part of a combination vessel, FIG. 3B is a schematic bottom view showing the cap type sealing tool, and FIG. 3C is a schematic cross-sectional view showing a section of a ring portion constituting part of the cap type sealing tool taken along line A—A of FIG. 3(A) which is seen from the cap portion side, and FIGS. 4(A)–4(C) show further aspects of the invention, wherein FIG. 4A is a front view showing a bottle portion constituting part of the combination vessel, FIG. 4B is a schematic longitudinal sectional view, and FIG. 4C is a schematic cross-sectional view showing a section of the bottle portion taken along line A—A of FIG. 4(A) which is seen from above.

DESCRIPTION OF THE PREFERRED EMBODIMENTS

Figure 1A:
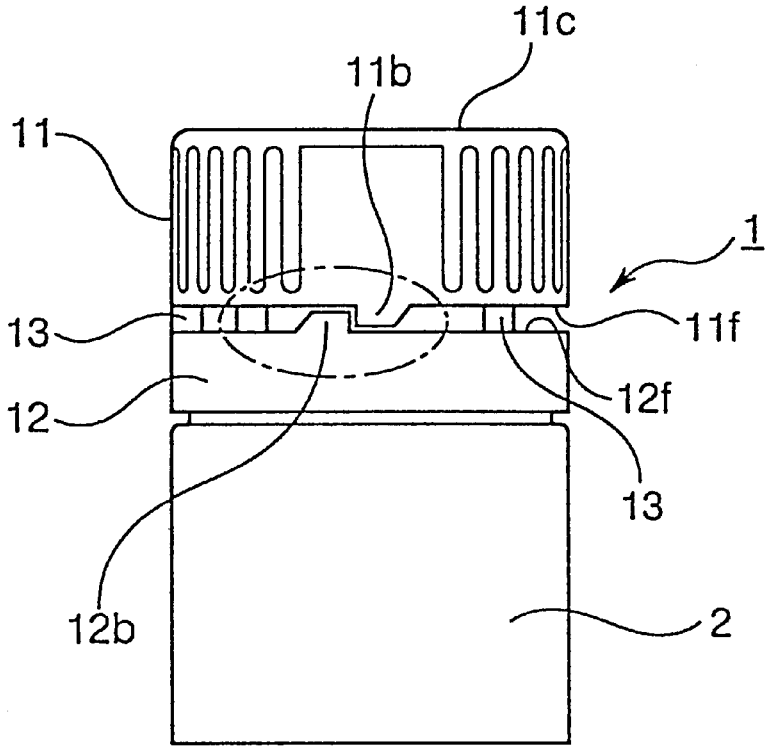

A combination vessel of a cap type sealing tool and a bottle portion having an upward spread neck zone according to the present invention is arranged by improving a coupling seal tool coupled to an upper surface of a ring portion via a plurality of bridge parts (coupling zone) capable of being easily broken. The bridge parts are extended from a lower end surface (a part surrounding an opening area of a cap portion) of the cap portion having a right (clockwise) thread provided as a female screw on an inner peripheral surface thereof. Also, the shape of the neck zone of the bottle portion mounting the cap type sealing tool is improved.

A bridge part 13 couples a cap portion 11 and a ring portion 12.

A cap type sealing tool 1 includes downwardly and upwardly extending engagement protrusions 11*b* and 12*b* for rotation with the ring portion 12 while maintaining the bridge part 13. The cap type sealing tool 1 is also for fastening, via screw threads, to a neck zone (whole area) 2*n* of a bottle portion 2 when the cap portion 11 is turned in a closing direction to carry out mounting of the cap type sealing tool 1 to the bottle portion 2.

There are provided one downwardly extending engagement protrusion provided on the lower end surface of the cap portion 11, and one upwardly extending engagement protrusion provided on an upper surface of the ring portion 12, which are engaged with each other during the fastening (mounting) of the cap type sealing tool 1 to the bottle portion 2 via the screw threads.

The ring portion 12 is provided with sliding protrusions (press fitting protrusions) 12*uc* that are separate from the upwardly extending engagement protrusion 12*b* and the downwardly extending engagement protrusion 11*b*, that serve to break the bridge part 13 and to separate the ring portion 12 from a lower end surface 11*f* of the cap portion 11, upon turning the cap sealing tool 1, to remove the cap portion (i.e. turning the cap sealing tool 1 leftward in a right thread system). The sliding protrusions 12*uc* serve to contact, by pressure, an upward spread zone 2*nx* when the ring portion 12 is pulled down such that the ring portion 12 slides along the upward spread zone 2*nx* formed on an external wall of the neck zone of the bottle portion 2.

Figure 3A:
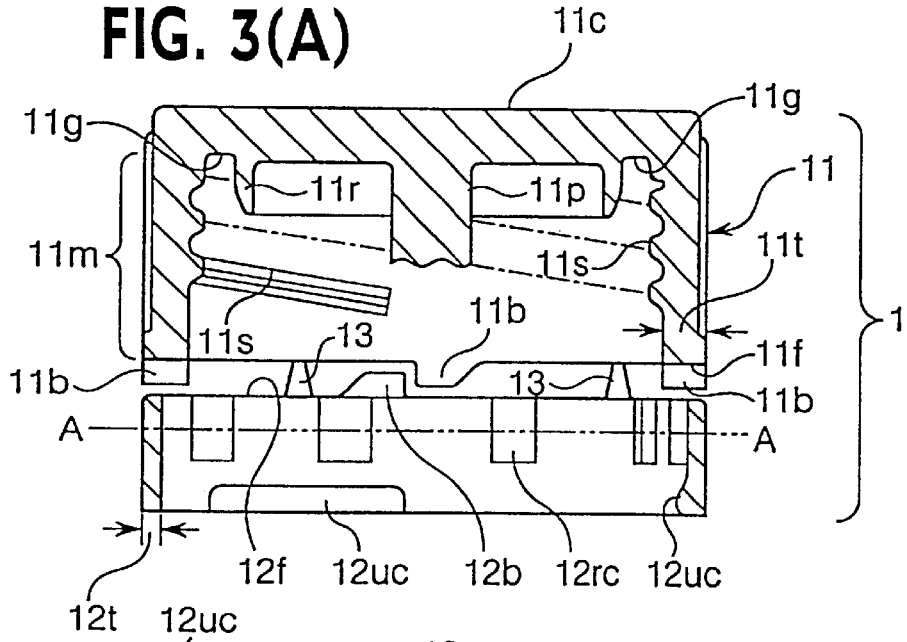
Figure 3B:
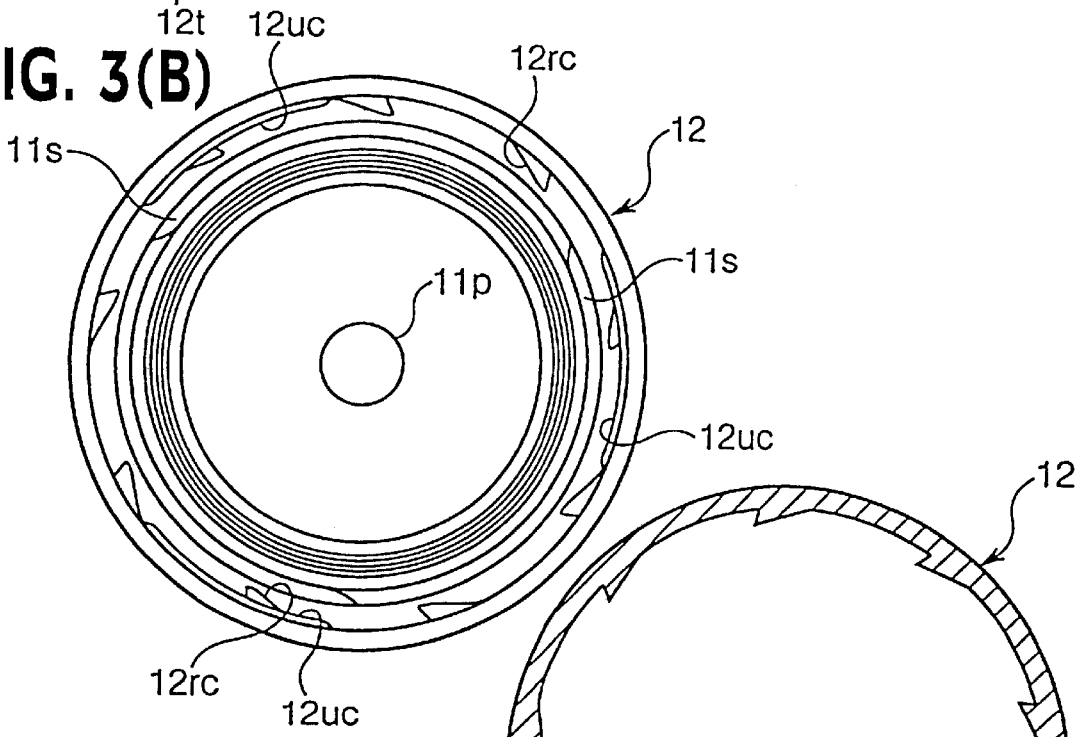
Figure 5:
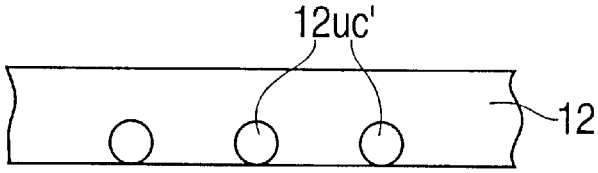
FIG. 5 shows an alternative configuration of sliding protrusions on an inner wall of a ring member forming part of the cap type sealing tool.
Figure 6A:
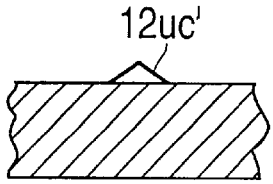
FIGS. 6(A)–6(D) show alternative cross-sectional configurations of the sliding protrusions of FIG. 5.
Figure 6B:
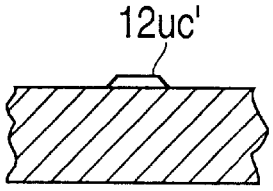
Figure 6C:
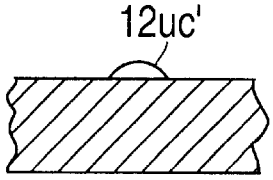
Figure 6D:
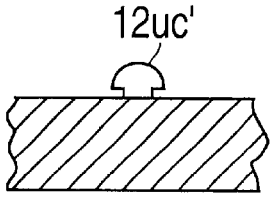

As an alternative to straight protrusions 12*uc* as shown in FIG. 3(B), sliding protrusions 12*uc*' which are nearly dot-like can be provided, as shown in FIG. 5. FIGS. 6(A)–6(D) show that these dot-like protrusions can have cross-sectional shapes that are nearly triangular, nearly tapered trapezoidal, nearly semi-circular and nearly mushroom-shaped, respectively.

The shape of a vertical convexity or projection (vertical groove: vertical ratchet) 12*rc*, to block an opening turn of the cap type sealing tool 1, provided on an inside of the ring portion 12 can be mutually engaged with a vertical convexity or projection (vertical groove: vertical ratchet) 2*rc*, to block an opening turn of the cap type sealing tool 1, provided on an external wall of the bottle portion 2. Consequently, also in the case in which the cap type sealing tool 1 is to be turned in a direction to remove the cap portion, it is possible to achieve a "temporary mounting" state in which removal from the bottle portion 2 can be carried out without breaking the bridge part 13.

More specifically, the cap type sealing tool 1 according to the present invention has the following mechanisms and shapes.

In a middle stage area 2*sz* on an external wall of the neck zone of the bottle portion 2, two or more vertical convexities 2*rc* for blocking an opening turn of the cap type sealing tool 1 are usually provided in symmetrical positions with respect to a center of the bottle portion 2. The convexities 2*rc* are usually nearly sawtooth in shape. In an upper stage area of an internal wall of the ring portion 12, moreover, a vertical convexity 12*rc*, to block the opening turn of the cap type sealing tool 1, to be engaged with the vertical convexities 2*rc* is provided. When the cap type sealing tool 1 is to be mounted on the bottle portion 2, the vertical convexities 2*rc* and the vertical convexity 12*rc* do not prevent fastening via screwing.

To the contrary, when the cap type sealing tool 1 is to be turned in an opening direction (a direction to remove the cap portion) for removing the cap portion, the accompanied turn of the ring portion 12 is controlled so that only the cap portion 11 is to be removed, thereby supporting breakage of the bridge part 13, the pushdown of the ring portion 12, and a motion for causing the sliding protrusions 12*uc* in the lower stage of the internal wall of the ring portion 12 to be slid downwardly while pressing against the upward spread zone 2*nx* of the neck zone 2*n* of the bottle portion 2.

As a thread (screw) system composition to be used for turning and fixing the bottle portion 2 and the cap type sealing tool 1, usually, a three-fold thread (triple thread) is sufficient. Furthermore, if a multi-thread is employed, the cap portion 11 can be opened and closed more rapidly. Referring to a demand for rapidly opening and closing the cap portion, usually, the three-fold thread (triple thread) is preferable.

In order to prevent over-fastening when the cap type sealing tool 1 is to be closed by screwing, a part to block an over-revolution (screw stopper) 2*sb* is provided in a proper position. Consequently, an overall height obtained after closing the cap portion (i.e. a distance from an external wall of a bottom area of the bottle portion to an uppermost point of the cap type sealing tool 1) can be maintained to be almost uniform for any position along a peripheral edge of a top plate of the cap type sealing tool.

In order to maintain airtightness of an inside of the bottle portion 2, there is basically employed structure for causing an internal annular portion 11*r* suspended from an internal lower surface of a cylindrical portion of the cap portion 11 to come into close contact with an opening area 2*mu* on an upper end of the bottle portion 2, and for fitting the internal annular portion 11*r* therein. To insert the annular portion 11*r* into the opening area 2*mu*, usually it is convenient to turn and press the internal annular portion 11*r*. The most practical structure to enable the rotation and pressing of the annular portion 11*r* and the opening are 2*mu* is a thread.

In this case, a screwing operation is also excellent to provide airtightness. On the other hand, a cap portion opening torque is increased. Therefore, it is hard to rapidly open the cap portion. As an approach for relieving this inconvenience, a multi-thread is also used. However, in the case in which the multi-thread is to be employed, a sufficient fastening strength is hardly achieved if a width of a thread providing area (i.e. a distance from a starting point of the thread to an end point thereof which travels over a central axis) is small.

As another different structure for relieving the above-mentioned difficulty realized with regard to the close contact and fitting of the annular portion 11*r* into opening area 2*mu* due to the thread, it is possible to employ bayonett fitting. To do so, a surface of the internal annular portion 11*r* is provided with a downwardly tapered gradient to approach a lower end thereof, wherein an outer diameter of a lower end area of the internal annular portion 11*r* is nearly equal to or slightly smaller than a diameter of an upper end of opening area 2*mu*. Furthermore, an outer diameter of an upper end area of the annular portion 11*r* is slightly larger than the outer diameter of the upper end of opening area 2*mu*.

In an autoclave sterilization operation (usually carried out at 121° C. for 30 min) as one manner for sterilizing the combination vessel according to the present invention at a high temperature, at least one of the bottle portion 2 and the cap type sealing tool 1 is sometimes deformed due to a high temperature condition. The reason for this is that a partial reduction in a dimension may result on at least one of the bottle portion 2 and the cap type sealing tool 1 because of exposure to a high temperature treatment. In order to eliminate or prevent this partial reduction in dimension (contraction) after formation, it is also useful to carry out annealing immediately after formation of the combination vessel. The annealing is a treatment for relieving a thermal distortion remaining in a molded product by slowly cooling the molded product during its formation, and for ideally eliminating the thermal distortion.

A plurality of concavo-convexities having a mutual space of 15% to 90% of an outside diameter of a contact lens, and having a difference in height of 5% to 60% of a thickness at a nearly central position of the contact lens, is provided on a bottom area of an inside of the bottle portion 2. Consequently, in the case in which a small-sized object such as a contact lens, which has a flat face positioned on at least one side, is dropped in the bottle portion, it is possible to prevent such a situation in which the small-sized object sticks to a bottom area of the bottle portion and is thus hard to remove therefrom.

Preferred embodiments of the present invention will be specifically described below with reference to the drawings. However, the scope of the present invention is not restricted to these embodiments.

FIG. 1A is a schematic side view showing a situation in which a cap type sealing tool of a combination vessel according to the present invention is mounted on a bottle portion. In FIG. 1A, the reference numeral 1 denotes the cap type sealing tool and the reference numeral 2 denotes the bottle portion on which the cap type sealing tool 1 is mounted. The cap type sealing tool 1 is mainly constituted by a cap portion 11 and a ring portion 12.

<Cap Portion 11 and Ring Portion 12>

The cap portion 11 is mainly constituted by an inverted bottomed cylinder having one end including a cylindrical portion 11*m* closed by a top plate part 11*c*. An outer wall of an opening area of the cap portion 11 serves also as a lower end surface 11*f* of the cap portion 11 ("upper, lower, left, right, middle, flat, front, inner" and the like are expressed for convenience of description in this specification), and a plurality of coupling devices (which will be hereinafter referred to as "bridge parts") 13, which are comparatively thin and can easily be broken, are extended downwardly from the lower end surface 11*f* to reach an upper surface (top surface) of the ring portion 12 which will be described below, thereby coupling the cap portion 11 to the ring portion 12.

Figure 3C:
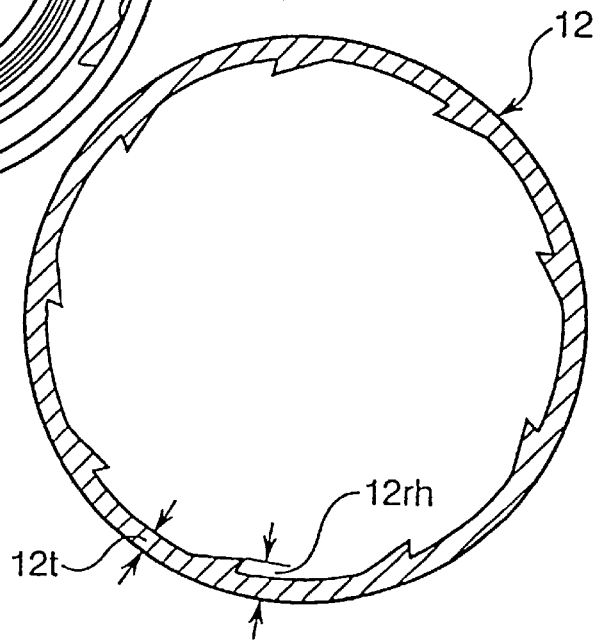

FIGS. 3(A)–3(C) show these relationships in more detail. Therefore, description will be given with reference to FIGS. 3(A)–3(C). Since FIG. 3(A) is a schematic view, a configuration showing the bridge part 13 to be directly coupled to the upper surface of the ring portion 12 is slightly different from actual situations.

FIGS. 3(A)–3(C) show a preferred embodiment of the cap type sealing tool 1 according to the present invention. FIG. 3A is a schematic longitudinal sectional view, FIG. 3B is a schematic bottom view and FIG. 3C is a schematic cross-sectional view taken along a plane A—A of the ring portion 12 (represented by the line A—A in FIG. 3(A)).

Figure 2:
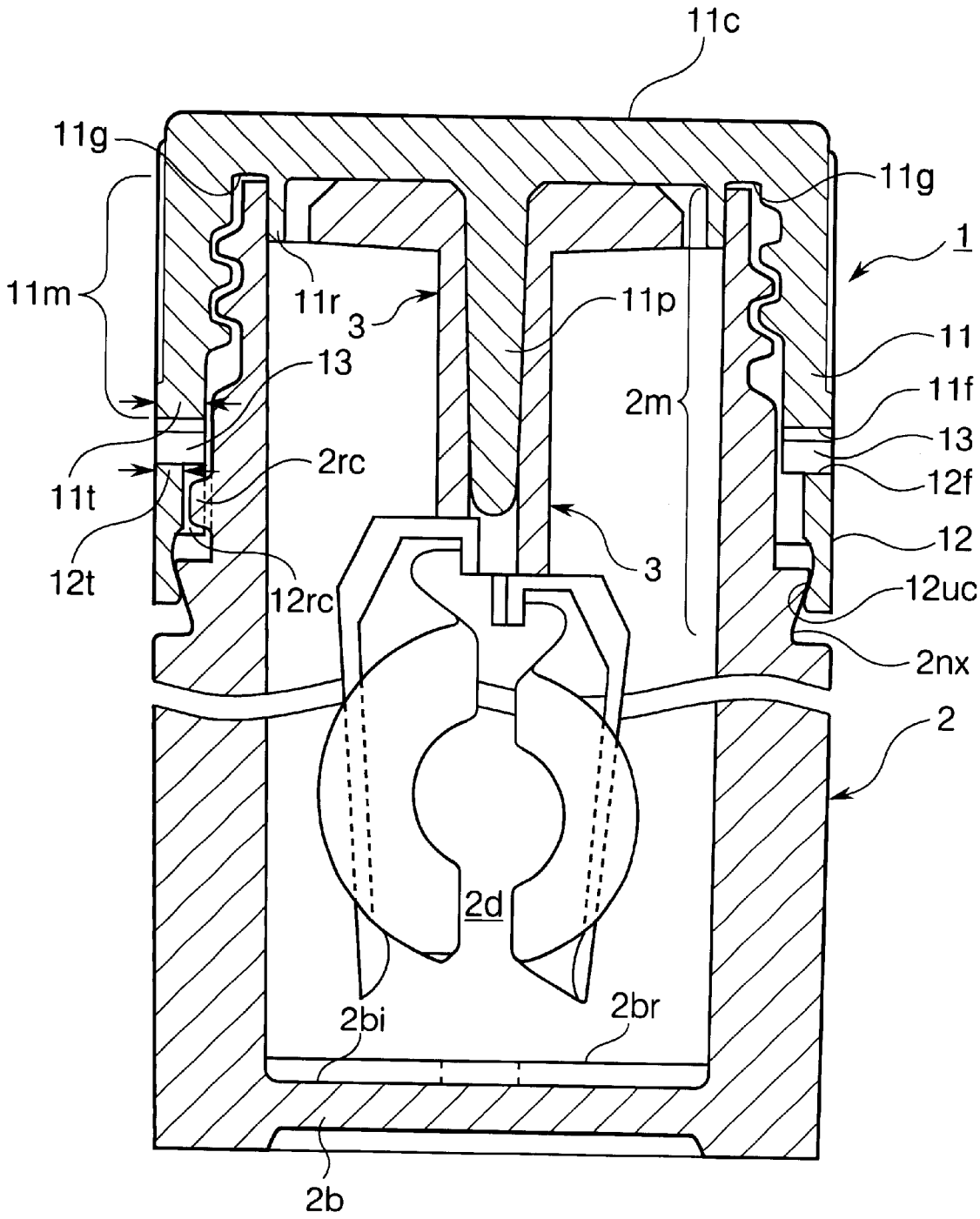
FIG. 2 is a schematic longitudinal sectional view showing a state in which the cap type sealing tool is mounted on the bottle portion.

As shown in FIGS. 2 and 3A, the cap portion 11 includes a plurality of (four in FIGS. 3A and 3B) sawtooth-type engagement protrusions (downwardly extending engagement protrusions) 11*b* provided extending downwardly from the lower end surface 1*f* of the cylindrical portion 11*m* at positions which are not adjacent to each other. Positions which are not adjacent to each other imply mutually symmetrical positions with respect to a central axis, for example, for any one of upwardly extending engagement protrusions and the downwardly extending engagement protrusions, but are not restricted to the aforesaid relationship. Also, in a case in which any one of two or more central angles formed by an arc connecting centers of two adjacent downwardly extending engagement protrusions with respect to a center has a different value, particular examples of the above-mentioned embodiment are explained.

FIG. 3A shows an embodiment in which the four downward engagement protrusions 11*f* are spaced by 90° intervals. Also in the case in which four downward engagement protrusions 11*f* are provided, the closest engagement protrusions may be spaced from one another by 60° and more distant engagement protrusions may be spaced from one another by 120°.

The downwardly extending engagement protrusions 11*b* serve to cause the cap type sealing tool 1 to be turned in a closing direction (a sealing direction) together with the ring portion 12 such that a vertical convexity 12*rc*, which is to block an opening turn of the cap portion 11, centrally extending from an internal wall becomes positioned over a vertical convexity 2*rc*, which is to block an opening turn of the cap portion, provided at a middle stage area of neck zone 2*n* of the bottle portion 2, and such that the bridge parts 13 are prevented from being broken while closing the cap portion 11 via screwing the cap portion.

For this purpose, the downwardly extending engagement protrusions 11*b* should be engaged with (i.e. should not be positioned over) sawtooth upwardly extending engagement protrusions 12*b*, which are provided on and extend upwardly from an upper surface (i.e. a surface opposite to the lower end surface 11*b* of the cap portion 11) 12*f* of the ring portion 12 only during closing of the cap portion 11 by screwing the cap portion.

In a right thread method, therefore, each downwardly extending engagement protrusion 11*b* on the cap portion 11 is formed with a configuration such that a left edge thereof extends at approximately 90° with respect to the lower end surface 11*b* (approximately 270° if the right direction of the lower end surface is set to a positive direction), while each upwardly extending engagement protrusion 12*b* on the ring portion 12 is formed with a configuration such that a right edge thereof extends at approximately 90° with respect to the lower end surface 11*b*.

In FIG. 3A, a female thread 11*s* is provided on an internal wall of the cap portion 11, and is engaged with a male thread 2*s* provided on an external wall 2*sz* in the upper stage of the neck zone 2*n* of the bottle portion 2 shown in FIG. 4 so that the cap type sealing tool 1 is attached to or detached from the bottle portion 2. In the preferred embodiments shown in FIGS. 3 and 4, a three-fold thread is employed as the thread.

A lower end (a right end: a starting end) of the female thread 11*s* shown in FIG. 3A is formed to have such a shape ("square cut") as to be cut nearly vertically in a direction of progress of the thread. The reason for this is as follows.

When the cap portion 11 is to be excessively turned for closing the cap portion, the square cut formed on a lower end of the female thread 11*s* on the internal wall of the cap portion 11 is intended for abutting with a convexity 2*sb*, provided on the external wall 2*sz* in the upper stage of the neck zone of the bottle portion 2, such that over-fastening of the cap portion 11 can be prevented effectively.

The convexity 2*sb* is a vertical protrusion having a comparatively great thickness (width), which is provided (suspended) nearly vertically with respect to the male thread 2*s* to extend downwardly from the vicinity of the lower end (left end; starting end) of the male thread 2*s*.

As far as effective prevention of over-fastening of the cap portion 11 is achieved, the shape of the lower end of the male thread 11*s* is not restricted to a square cut but may be a double round-cornered square cut, which is obtained by deformation or is a square cut formed by rounding both corners. However, it is preferable that the extent of corner cutting should be controlled within a range such that the lower end of the female thread is recognized to be substantially straight or a circular arc having a large diameter. If the corner cutting or corner rounding processing is carried out such that the lower end of the female thread seems nearly acute, reliable blocking of over-fastening is hardly expected.

The reason why the three-fold thread is employed in the present invention is that it takes a long time to mount or remove a single threaded cap portion, which makes a single thread inconvenient. The present inventor investigated how many fold of threads is preferable from the viewpoint of a balance of fastening strength, stability, ease of attachment and removal, to arrive at the triple thread (three-fold thread). A four-fold thread is less practical for a small-sized article employed in the combination vessel tool according to the present invention. In other words, when a four-fold thread is employed in small-sized articles, the thread is too thin and the length thereof is too short to securely fasten the cap portion to the bottle portion.

<Ring Portion 12>

As shown in FIG. 3A, the ring portion 12 constituting part of the cap type sealing tool 1 according to the present invention is an annular band having a thickness 12*t* that is generally smaller than a thickness 11*t* of the cylindrical portion 11*m* of the cap portion 11. The reason for this is that the sum of a height (overhang) of the vertical convexities (vertical ratchets) 12*rc*, extending from the internal wall of the ring portion 12 toward nearly a center thereof, and the thickness of the ring portion 12 should be nearly equal to the thickness of the cylindrical portion 11*m* of the cap portion 11 (i.e. a thickness from an outer periphery of the cylindrical portion 11*m* to a bottom of a screw trench in the inner wall of the cylindrical portion 11*m*).

The vertical convexities 12*rc* serve to be engaged with the vertical convexities 2*rc* provided on the external wall of the neck zone 2*n* of the bottle portion 2 to prevent the ring portion 12 from being moved via a left turn (in the right thread system) for attachment and removal of the cap portion 11.

The ring portion 12 has a sliding protrusion (or a sliding convexity; undercut) 12*uc* provided in a predetermined part in a lower stage area of the internal wall of the ring portion 12. The sliding protrusion 12*uc* substantially increases the thickness of the internal wall of the ring portion 12 so that it serves to form a downward taper (upward spread) on the internal wall of the ring portion 12. As another method of forming the downward taper (upward spread) on the internal wall of the ring portion, the internal wall in the lower stage area of the ring portion 12 has a greater thickness than that of the internal wall in an upper stage area of the ring portion 12, or conversely, it is also useful if the internal wall in the upper stage area of the ring portion is slightly scooped out to provide a downward taper gradient.

In order to pull down the ring portion 12 while always contacting, by pressure, an upward spread zone 2*nx*, which is on the external wall of the bottle portion 2, it is required that a diameter of a circle connecting edge portions of sliding protrusions 12*uc* extending from the internal wall in the lower stage area of the ring portion 12 toward a central axis thereof is 0.85 to 1.0 based on a ratio to a diameter of the external wall in the neck zone 2*n* of the bottle portion 2. It is preferable that the ratio is from 0.90 to 0.99.

In this case, it is useful that the position of the lower end of the vertical convexity 12*rc* extending from the internal wall of the ring portion 12 is adjusted such that the sliding protrusions 12*uc* provided in the lower stage area of the internal wall of the ring portion 12 approaches the upward spread zone 2*nx* provided in the lower end area of the neck zone 2*n* of the bottle portion 2. This approach is important for breakage of the bridge parts 13 and descent of the ring portion 12.

The downward movement of the ring portion 12 is caused by pulling down the ring portion 12 while the sliding protrusions 12*uc*, provided in the lower stage zone of the internal wall of the ring portion and centrally extending, always contact, by pressure, the upward spread zone of the external wall of the bottle portion subsequent to the breakage of the bridge parts 13. Subsequently, the sliding protrusions 12*uc* provided arcuately in the lower stage zone of the internal wall of the ring portion 12 are slid downwardly on a surface of the upward spread zone 2*nx* while contacting the upward spread zone 2*nx* via pressure. Thus, downward movement of the ring portion 12 results. The sliding protrusions 12*uc* finally reach the lower end of the upward spread zone 2*nx* and are fixed at that position.

Accordingly, an innermost end of each sliding protrusion 12*uc* in FIG. 2 is formed to be fixed at a most constricted position (having a small diameter) at the lower end of the upward spread zone 2*nx* during formation of the cap type sealing tool 1. However, as far as a cap portion closing state is set, the innermost end of each sliding protrusion 12*uc* contacts the vicinity of the upper end of the upward spread zone 2*nx* by pressure.

FIG. 3B is a schematic bottom view showing the cap type sealing tool 1 according to the present invention as viewed upwardly, in which an area interposed between a circle surrounding an outermost side and a concentric circle positioned directly inside thereof indicates the ring portion 12. A sawtooth type portion extending from the internal wall of the ring portion 12 toward a central portion indicates a vertical convexity 12*rc* which is to block an opening turn of the cap portion 11. An area interposed between two concentric circles positioned inwardly of the vertical convexity 12*rc* and having three parts partitioned by a slant line indicates three threads 11*s*. Three concentric circles positioned inwardly of the threads 11*s*, and three concentric circles positioned further inwardly are annular convexities, respectively. It is apparent that the annular convexities serve to abut an inner peripheral edge of the opening 2*mu* of the bottle portion 2 in the former case, and serve to be fitted in the opening 2*mu* to achieve airtightness in the latter case. However, these annular convexities will not be described any more. A circle shown on an innermost side in FIG. 3B indicates a suspending pin 11*p* that extends downwardly from a bottom surface (back face) of the top plate part 11*c* constituting part of the cap portion 11.

In FIG. 3B, furthermore, it is apparent that three crescent-shaped (arcuate) portions 12*uc* are provided on the internal wall of the ring portion 12, which are the sliding protrusions 12*uc* and always slide and bring down the ring portion 12 while contacting, by pressure, the upward spread zone 2*nx* positioned on the lower end of the neck zone 2*n* of the bottle portion 2.

FIG. 3C shows the shape of a section of the ring portion 12 taken along the line A—A which is seen from the cap portion side, and illustrates a sawtooth type portion that includes the vertical convexities 12*rc*, a height 12*rh* of the vertical convexities 12*rc* and a thickness 12*t* of the ring portion 12.

<Bridge Part 13>

Figure 1B:
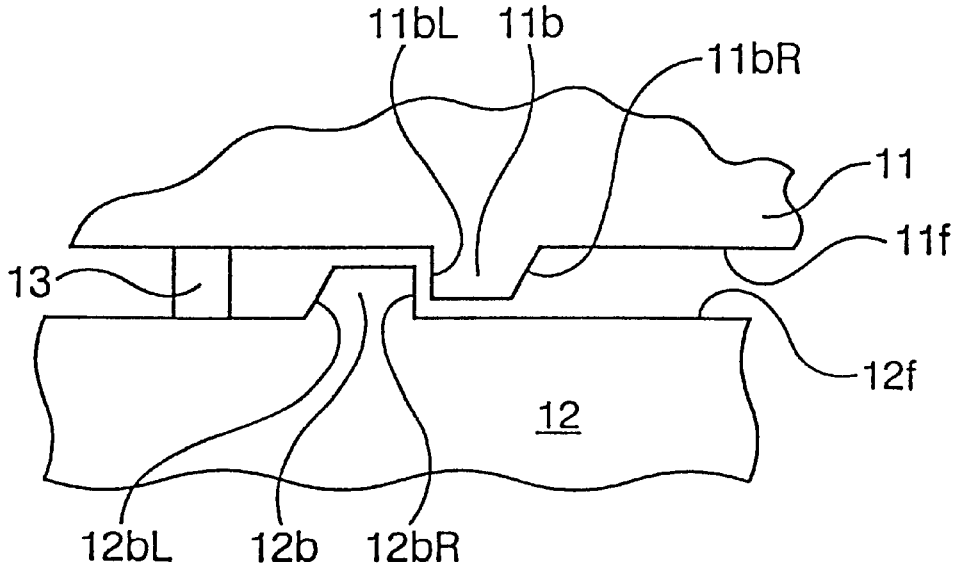

As shown in FIG. 3A, each bridge part 13 is formed so comparatively weak as to be easily broken when the cap portion 11 is turned with respect to the ring portion 12. The number of the bridge parts 13 is six in the embodiment of FIG. 1, which is not restricted as a matter of course. The bridge parts 13 are usually fabricated integrally during the formation of the cap portion 11 and the ring portion 12.

<Neck Zone 2*n* of Bottle Portion 2>

Figure 4A:
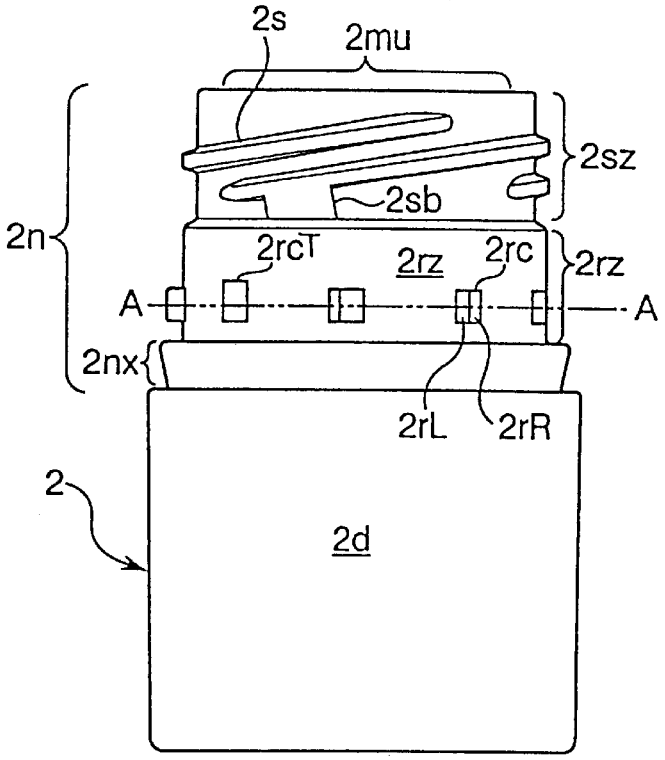

With regard to the bottle portion 2, which is to contain liquid and constitutes part of the combination vessel according to the present invention, the cap type sealing tool 1 is mounted on the neck zone 2*n* as shown in FIG. 2. On the other hand, as shown in FIG. 4A, the thread 2*s* is provided by using a right screw as a male screw on an external wall in almost an upper stage area (upper stage area of the neck zone) 2*sz* in the neck zone 2*n* of the bottle portion 2, a plurality of vertical convexities 2*rc* are usually provided on a cylindrical area (the middle stage area of the neck zone: vertical convexity area) 2*rz* positioned in the middle stage area of the neck zone 2*n* of the bottle portion 2, and the upward spread zone 2*nx* is formed below the vertical convexities 2*rc* (the lower end area of the neck zone) through a diameter increasing area. An upward spread gradient of the upward spread zone 2*nx* should usually be set to 0.15 to 1.4. In most cases, it is preferable that the gradient is set to 0.2 to 1.3. The gradient has a value expressed by the following equation: (an outside diameter of an upper end face of the area—an outside diameter of a lower end face)/(the smallest space between both end faces in the area).

FIG. 2 is a schematic longitudinal sectional view showing a state in which the cap type sealing tool 1 according to the present invention is mounted on the neck zone 2*n* of the bottle portion 2 after breakage of the bridge parts 13. In FIG. 2, the cap portion 11 is mounted on the neck zone 2*n* of the bottle portion 2 and the right screw is used for engaging the cap portion 11 and the bottle portion 2. Thin coupling zones extending from the lower end surface of the cap portion 11 and reaching the upper surface of the ring portion 12 positioned below the lower end surface is referred to as the bridge parts 13, which can indicate by inspection whether or not the cap type sealing tool 1 is opened.

A downward taper (an upward spread) shape having a slightly increased thickness is formed in the lower end area of the internal wall of the ring portion 12. The downward taper (upward spread) shape of the ring portion 12 serves to slide the ring portion 12 downwardly while contacting, by pressure, the downward taper area 2*nx* provided in the lower end area of the neck zone 2*n* of the bottle portion 2, thereby always bringing down the ring portion 12 and avoiding a situation in which the ring portion 12 is separated unexpectedly (erratically) after the cap portion 11 is removed.

As shown in FIG. 2, in the state in which the cap type sealing tool 1 according to the present invention is mounted on the bottle portion 2, it is apparent that the vertical convexities 12*rc* extending inwardly from the internal wall of the ring portion 12, and the vertical convexities 2*rc* provided in the vertical convexity area 2*rz* on the external wall of the middle stage in the neck zone 2*n* of the bottle portion 2, are to engage with each other to prevent motion of the ring portion 12 upon turning the cap portion. Both sets of vertical convexities work to prevent the ring portion 12 from being moved with the cap portion 11 when the cap type sealing tool 1 according to the present invention is turned for opening the cap portion (counterclockwise rotation; leftward rotation in a right thread system).

It is important that the vertical convexities 2*rc* on the bottle portion and the vertical convexities 12*rc* on the ring portion are provided in pairs; the former extending from the (basic cylindrical area) external wall 2*rx* of the basic cylindrical area 2*rz* positioned in the middle stage area of the bottle portion 2, and the latter extending from the internal wall of the ring portion 12 at positions almost corresponding to both ends having an inside diameter of the ring portion. Therefore, two pairs are usually sufficient.

<Variant of Cap Type Sealing Tool>

In a cap portion of a vessel for accommodating, washing or inspecting a small article such as a contact lens according to an example of the usage configuration of the cap type sealing tool 1 constituting part of the combination vessel according to the present invention, the suspending pin 11*p* may extend downwardly from the bottom surface of the top plate part 11*c* of the cap portion 11. The suspending pin 11*p* serves as a medium for fixing an adaptor 3 (suspending tool) or the like for suspending an analyte(object to be treated etc.) or the like in the bottle portion 2. In this case, screwing, bayonett fitting, press fitting, interposing fitting and the like can be properly used for fixing the cap portion to the bottle portion. Moreover, a portion where the adaptor 3 suspends the analyte(object to be treated etc.) or the like may be of a clip type, a caliper type, a hanging bell type and the like, for example.

FIG. 2 illustrates two kinds of suspending tools 3 having mutually different sizes provided on both sides of the suspending pin 11*p*, left and right half parts being shown. A crescent-shaped portion having the same shape as that of a crescent-shaped (arcuate; nearly semicircular arc) portion in a lower half part of the suspending tool 3 is positioned with a comparatively small space on an inner part of the paper with several cross rails (not shown) being coupled therebetween, thereby forming a ladder type suspending tool (not shown). A contact lens or the like is held between the right and left suspending tools.

<Bottle Portion 2>

The bottle portion 2 constituting part of the combination vessel according to the present invention is shown in a schematic side (outside) view in FIG. 1A and in a schematic longitudinal sectional view in FIG. 2. A lower half part (housing zone) 2*d* of the bottle portion 2 in FIG. 2 is briefly described because it is the same as that in an ordinary bottle portion. On the other hand, a middle stage portion of the bottle portion 2 is abbreviated and the neck zone (upper half part) 2*n*, that is an area on which the cap type sealing tool 1 is mounted is shown in detail.

As is apparent from FIG. 2, the bottle portion 2 is a nearly cylindrical bottomed member. An upper end of the bottle portion 2 is illustrated as an open end 2*mu* and a male thread 2*s* (usually, a right thread system) is provided on an external wall of cylindrical area (thread area) 2*sz* that extends the open end 2*mu*. The male thread 2*s* is provided to be screwed to the female thread 11*s* provided in the upper part of the internal wall of the cap portion 11 to be mounted (externally fitted) on the bottle portion 2.

Figure 4B:
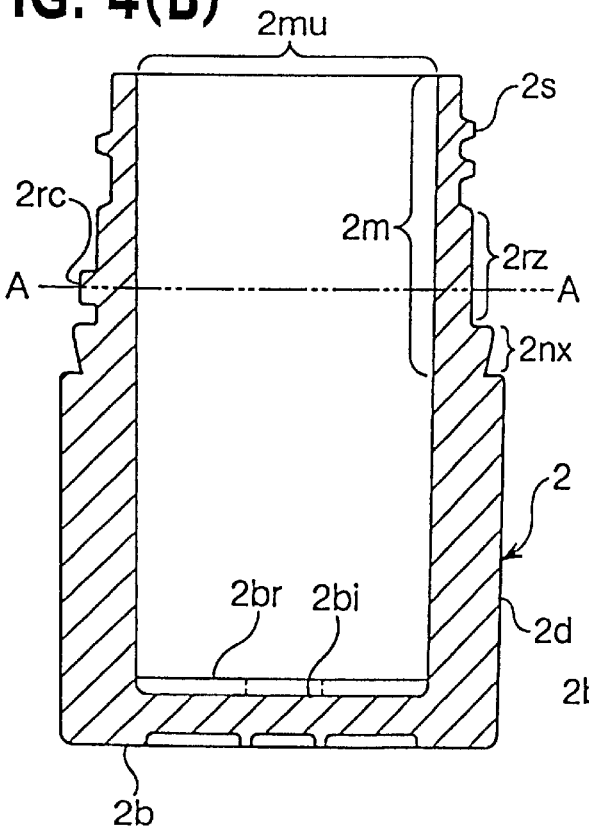
Figure 4C:
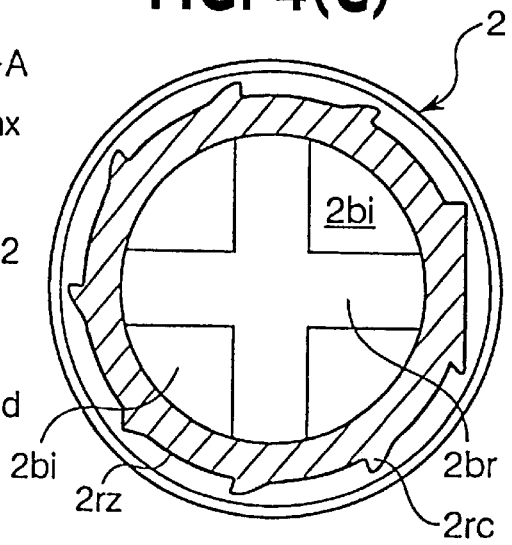

An adjacent cylindrical area (vertical convexity area) 2*rz* is continuously provided under the male thread area 2*sz* through a slight diameter increasing portion. In the cylindrical area 2*rz*, an interaction is carried out, for example, four downwardly extending engagement protrusions 11*b* provided on the lower end surface 11*f* of the cap portion 11 are engaged with or positioned over two upwardly extending engagement protrusions 12*b* provided on the upper surface 12*f* of the ring portion 12. FIGS. 4(A)–4(C) show, in detail, an external shape of the bottle portion 2, configuration of the thread, configuration of the vertical convexities, configuration of the upward spread zone and the like. Therefore, description will be given with reference to FIG. 4.

FIG. 4 shows various preferred embodiments according to the present invention. FIG. 4A is a schematic front view showing the bottle portion 2, FIG. 4B is a schematic longitudinal sectional view showing the bottle portion 2, and FIG. 4C is a schematic cross-sectional view showing a section of the bottle portion 2 taken along the line A—A as viewed downwardly from the cap portion side. Although a vertical convexity and a cylindrical surface are to be essentially formed on the right-hand side in FIG. 4C, some portions are illustrated as a straight line, which is caused by convenience when pulling out a product from a mold during actual molding.

In FIG. 4A, the reference numeral 2 denotes a whole vessel, an area provided continuously on the lower half part 2*d* is the upward spread zone (inverted circular cone face) 2*nx*, a cylindrical area provided continuously on the upward spread zone 2*nx* through a diameter reducing area is the vertical convexity area 2*rz*, and a predetermined number of (eight in the drawing) vertical convexities, which are to block the opening of the cap portion, (ratchets) 2*rc* are provided at predetermined positions on a periphery of the vertical convex area 2*rz*. A non-return (check) action is intended to block the leftward turn of the ring portion 12. Furthermore, a cylindrical area provided continuously on the vertical convex area 2*rz* through a diameter-reducing area is the male thread area 2*sz*.

The role of the vertical convexities 2*rc* provided in the cylindrical zone (vertical convexities rising zone) 2*rz* in FIG. 4A will be summarized below. In order to perform their role, it is preferable that a specific number of the vertical convexities 2*rc* are formed to be higher than the other vertical convexities 2*rc*. The expression "formed to be higher" implies that the specific number of the vertical convexities have top ends that extend upwardly beyond a line connecting upper apexes (upper apices; upper edges) of the other of the vertical convexities 2*rc*. The specific number of the vertical convexities and the other of the vertical convexities are juxtaposed with respect to each other.

The "specific number" has a numeric value corresponding to the number of the male threads 2*s* formed in the male thread zone 2*sz*. In the case in which a three-fold thread is provided, it can be expected that a predetermined role is performed in most cases if the specific number of vertical convexities is three. These vertical convexities can be said to be "higher vertical convexities". It is sufficient that a position where the higher vertical convexities is to be formed is set in the vicinity of a starting point of each thread constituting a multi-thread.

The higher vertical convexities serve to stably achieve temporary mounting of the cap type sealing tool 1 on the bottle portion 2. The "temporary mounting" implies that the cap type sealing tool 1 is mounted on the neck zone 2*n* of the bottle portion 2 and is then turned slightly in a closing direction, wherein the slight turn is stopped when the vertical convexities 12*rc* provided on the inner periphery of the ring portion 12 come into contact with the higher vertical convexities 2*rc* provided on the outer periphery of the bottle portion 2. The cap type sealing tool 1 and the bottle portion 2 are fitted, shipped and transported in this configuration of the combination vessel, and are delivered and accepted by a customer.

The customer turns the cap type sealing tool 1 of an accepted "temporarily mounted combination vessel" in an opening direction and thus removes (take off) the cap type sealing tool 1 from the bottle portion 2, and then supplies medicine, chemicals, a detergent or a preservative into the bottle portion 2, and thereafter mounts the cap type sealing tool 1 on the neck zone 2*n* of the bottle portion 2 again, thereby carrying out complete fitting by screwing (complete fastening).

In addition, the "complete fitting by screwing (complete fastening)" implies an operation to turn, in the closing direction, the cap type sealing tool 1 mounted on the bottle portion 2 after contents are accommodated therein and fastening by screwing until a second, and preferably, a third vertical convexity 2*rc*, to block the opening turn from the "higher vertical convex (2*rc*T)", and succeeding vertical convexes 2*rc* are passed. The sealing of the combination vessel subjected to be "completely screwed" is rarely loosened by itself.

The bridge parts 13 should be prevented from being broken when the cap type sealing tool 1 is to be removed via an opening turn from "temporary mounting" to feed contents until the "completely screwed" state is attained, which is very important and is hard to achieve.

It is a matter of course that the bridge parts 13 are to be broken surely through the opening turn of the cap portion carried out by end users.

In order to reliably prevent the bridge parts 13 from being broken through erratic opening turns of the cap portion, however, various trial experiments demonstrated that a conventional parallel vertical convexity method should not be employed.

As a solution for making incompatible requests with each other, the present inventors found that desirable effects could be achieved if all shapes of the vertical convexities 2*rc* are not deformed but a specific number of vertical convexities 2*rc* have different shapes from those of the other vertical convexities 2*rc*. Additionally, further investigations were made by the inventors. As a result, the present invention was completed.

More specifically, the present inventors solved the problems which are apparently incompatible with each other, by introducing, as the above-mentioned specific deformation, higher ("height degree") vertical convexities. "Higher vertical convexities (2*rc*T)" at a specific rate other than the other vertical convexities 2*rc* were provided. And the number of the higher vertical convexities (2*rc*T) was set to three or two, which is the number of the provided male threads.

The number of the "higher vertical convexities (2*rc*T)" is important and when excessive in number they are harmful. Accordingly, it is required that the number of the "higher vertical convexities (2*rc*T)" should be minimized.

The reason for this is that an excessive number of "higher vertical convexities (2*rc*T)" breaks the bridge parts 13 via the opening turn. A critical number of "higher vertical convexities (2*rc*T)" can be confirmed by experiments. As a result of investigations by the present inventors, usually, the number thereof ranges from two to the maximum number of threads. In some cases, in which a minimum number of the "higher vertical convexities (2*rc*T)" is one, a predetermined target might be achieved. However, the number of "1" provides some problems with regard to stability (reliability) of an operation.

A ratio of a length of the "higher vertical convexity (2*rc*T)", having a height degree (R %) to that of an "ordinary vertical convexity 2*rc*" is expressed by the following equation:

$$R=100\times(Lt-Ls)/Ls$$

wherein R represents the height degree, Ls represents the length of the ordinary vertical convexity, and Lt represents the length of the higher vertical convexity.

In most cases in which the "height degree" of the combination vessel according to the present invention is usually set to 10 to 45%, preferably, 15 to 40%, desirable effects can be achieved.

In FIG. 4A, a convexity 2*sb*, to block over-fastening (screw stopper), descends almost from an end positioned on a left lower corner in the three-fold thread 2*s* provided on the external wall 2*sz* in the upper stage of the neck zone of the bottle portion 2 along the external wall 2*sz* in the upper stage of the neck zone, and is suspended up to a position close to an upper end of the middle stage area 2*rz* of the neck zone succeeding to the upper stage area 2*sz*. Consequently, it is possible to prevent "over-fastening" when the cap type sealing tool 1 is to be screwed and mounted.

As shown in FIG. 4B, if the non-return function is to be revealed without consideration of the "temporary fastening", it is very preferable that the vertical convexity 2*rc* should have a nearly sawtooth (opening turn blocking type) cross-sectional shape. A left side surface 2*r*L of the vertical convexity 2*rc* should rise at an acute angle counterclockwise with respect to the external wall 2*rx* of the cylindrical area, and a right side surface 2*r*R thereof should be formed at an obtuse angle clockwise with respect to the external wall 2*rx* of the cylindrical area. In addition, it is preferable that at least one of the vertical convexity 2*rc* on the bottle portion side and the vertical convexity 12*rc* on the ring side should be formed comparatively thinly, for example, like a tongue.

The reason for this is as follows. If an edge line portion of at least one of the vertical convexity 12*rc* to block the opening turn (ratchet) on the ring side and the vertical convexity 2*rc* to block the opening turn 2*rc* on the bottle portion side, is extended like a tongue, a tongue-shaped portion 12*rf* or 2*rf* of one vertical convexity abuts the other vertical convexity, and can be flexed properly when the ring portion 12 is to be attached through screwing.

It is desirable that a concavo-convex shape 2*br* should be formed within a specific range over an internal wall 2*bi* of the bottom area ( bottom area of the bottle portion) 2*b* of the bottle portion 2 constituting part of the combination vessel according to the present invention as described above. The reason for this is as follows. In the case in which a small article to be subjected to various treatments in the bottle portion 2, particularly, a contact lens is dropped by mistake, it sticks to the internal wall (bottom plate) surface of the bottom area. As a result, it is necessary to avoid removing the contact lens with difficulty. As an approach to prevent this difficult removal, for example, it is preferable that various concavo-convex shapes 2*br* should be provided on the internal wall surface of the bottom area of the bottle portion 2.

Various concavo-convex shapes 2*br* to be provided on the internal wall surface of the bottom area of the bottle portion 2 include a comparatively regular concavo-convex shape such as one or more convexities, a grid convexity formed by a convexity intersecting the one or more convexities, a plurality of radial convexities protruded outwardly from the vicinity of a center of the internal wall surface in the bottom area of the bottle portion, or a web-shaped convexity group formed by one or more concentric circles or concentric polygons intersecting a radial convexity.

FIG. 4C shows a wide (thick) cross-shaped protrusion as a practical example of the protrusion 2*br* provided on the internal wall 2*bi* in the bottom area of the bottle portion. More specifically, in addition to the fact that this kind of protrusion shape can easily be formed, it is possible to effectively prevent a dropped lens from sticking to a bottom plate surface in many cases.

It is also possible to employ shapes for a bottom area that are different from the above-mentioned examples which are poor in regularities such as fine concavo-convexities, for example, a pear skin or a fishskin which are formed by a large number of almost identical elements.

Referring to the comparatively regular concavo-convex shapes described above, it is useful in removing a sticking lens or the like that a mean distance between the protrusions is 15 to 90% of an outside diameter of the lens, preferably, 20 to 85%, and that a mean height of the protrusion is 5 to 60% of a maximum thickness of the lens, preferably, 10 to 50%. As an example to be used practically, at least one convexity is provided with a mean value of a step of 0.1 to 1 mm, preferably, 0.2 mm to 0.8 mm, from an internal surface of a bottom of the convexity provided on the internal surface of the bottom of the bottle portion 2, and a mean width of the convexity is 2 to 8 mm, preferably 2.5 to 7 mm, in the bottle portion having a mean inside diameter of the bottom in the bottle portion of approximately 18 mm.

<Positional Relationship between a Portion 2*sb*, Preventing Over-fastening, and Fitting Dimension>

In the combination vessel according to the present invention, it is useful that a fitting dimension has a ratio (Rc/Rv) of an outside diameter (Rv) of the neck zone of the bottle portion to an inside diameter (Rc; a reference of a trench bottom of a female screw) of the cap portion 11 set to 0.5 to 0.75% [0.10 mm/20 mm to 0.15 mm/20 mm], preferably, 0.55 to 0.7% [0.11 mm./20 mm to 0.14 mm/20 mm] in order not to excessively increase a rotational torque during opening of cap portion.

Furthermore, the position of the over-fastening preventing portion 2*sb* is selected such that the rotational torque for the cap portion opening is usually 8×9.8 N-m or less, preferably, 6.5 N-m or less.

Moreover, the over-fastening preventing portion 2*sb* acts most effectively on the thread 2*s* positioned in the neck zone 2*n* of the bottle portion at an intersection angle of approximately 90°. The intersection angle is not restricted to approximately 90° but may be set to effectively prevent the progress of the thread 11*s* on the cap portion side which enters through screwing. If the intersection angle is usually set to 45 to 135°, preferably, 55 to 120° for the thread 2*s*, the over-fastening can be prevented effectively in most cases.

In addition to the above-mentioned measures, it is useful that the position of a ceiling surface (a trench bottom surface) of an annular trench 11*g* positioned between the annular convexity 11*r* for maintaining airtightness (watertightness), which extends downwardly from the peripheral edge portion of the bottom surface of the top plate 11*c* of the cap portion 11, and the internal wall of the cylindrical portion 11*m* in the cap portion 11 are set such that the peripheral edge of the opening area 2*mu* of the bottle portion 2 does not come into contact at its highest position, thereby leaving a slight gap in order to control rotational torque for opening the cap portion such that the cap portion can be opened by one hand.

<Positional Relationship between Prevention of Over-fastening and Staring Point of Multi-thread>

In the combination vessel according to the present invention, there is often employed a method of fixing (fastening) the cap portion 11 to the bottle portion 2 in close contact with each other, and fastening them together by any profitable manner such as screwing, in order to achieve easy opening of the cap portion. In order to realize the screwing, there is usually employed a method of forming the male screw 2*s* on the external wall of the neck zone 2*n* of the bottle portion 2, and of forming the female screw 11*s* on the internal wall of the cylindrical portion 11*m* of the cap portion 11.

In this case, however, a method of forming only one thread (single thread) unexpectedly requires a time for both mounting and opening. In order to shorten the time required therefor, a "multi-thread" system of simultaneously forming two or more threads is often employed. Usually, a two-fold thread (two-thread) is enough and a three-fold thread can sometimes achieve an increase in speed even more.

In the case in which this kind of multi-thread is to be formed, the position of the part 2*sb* to prevent over-fastening caused by over-rotation may be selected for the starting point of any one thread.

While the preferred embodiments have been shown and described in the specification according to the present invention, various modifications and substitutions may be made thereto without departing from the concept and scope of the present invention. Accordingly, it is to be understood that the present invention has been disclosed by way of illustration but not limited by the disclosure.

What is claimed is:

1. A vessel comprising:

a cap type sealing tool including (i) a cap portion having a bottomed cylindrical part, and (ii) a ring portion spaced from and coupled to a lower end surface of said cap portion via bridge parts which are to be easily broken so as to de-couple said ring portion from said cap portion and decrease the spacing therebetween, said ring portion including a projection extending inwardly from an internal wall of said ring portion and also including at least one sliding protrusion on a lower portion of said internal wall, with said projection being for blocking an opening turn of said cap portion; and a bottle portion having a cylindrical part with a first end and a bottomed second end, wherein said cylindrical part includes (i) a first projection extending outwardly from an external wall of said cylindrical part, said first projection being for blocking an opening turn of said cap portion, (ii) a second projection extending outwardly from said external wall of said cylindrical part, wherein said second projection is for blocking an opening turn of said cap portion and has an end that is positioned closer to said first end of said cylindrical part than is a corresponding end of said first projection, and (iii) a neck zone and an upward spread zone on an external wall of said neck zone;

such that upon rotation of said cap type sealing tool in a closing direction at least one of said first projection and said second projection extending outwardly from said external wall of said cylindrical part engages with said projection extending inwardly from said internal wall of said ring portion, whereby said bridge parts become broken and said ring portion is forced toward said bottomed second end of said cylindrical part and said at least one sliding protrusion on said lower portion of said internal wall of said ring portion travels along and exerts pressure against said upward spread zone simultaneously with or subsequently to the breakage of said bridge parts.

2. The vessel according to claim 1, wherein said at least one sliding protrusion on said lower portion of said internal wall of said ring portion comprises plural sliding protrusions on said lower portion of said internal wall of said ring portion, with innermost surfaces of said plural sliding protrusions defining a circle of a first diameter, and wherein said external wall of said neck zone defines a circle of a second diameter, with a ratio of said first diameter to said second diameter being from 0.85 to less than 1.0.

3. The vessel according to claim 2, wherein said plural sliding protrusions centrally extend from said lower portion of said internal wall of said ring portion and each have a shape corresponding to one of a nearly dot-like protrusion and a nearly straight projection, and with portions thereof which contact said upward spread zone having a cross-section that is slightly rounded and is one of nearly triangular, nearly tapered trapezoidal, nearly semicircular and nearly mushroom in shape.

4. The vessel according to claim 3, wherein a gradient of said upward spread zone is from 0.15 to 1.4, and is expressed as the remainder, of an outer diameter of an upper end face of said upward spread zone minus an outer diameter of a lower end face of said upward spread zone, divided by a length of said upward spread zone.

5. The vessel according to claim 2, wherein a gradient of said upward spread zone is from 0.15 to 1.4, and is expressed as the remainder, of an outer diameter of an upper end face of said upward spread zone minus an outer diameter of a lower end face of said upward spread zone, divided by a length of said upward spread zone.

6. The vessel according to claim 2, wherein said cap type sealing tool and said bottle portion are constructed and arranged such that upon rotation of said cap type sealing tool in the closing direction, said cap portion becomes temporarily mounted to said bottle portion when the rotation is stopped upon engagement of said second projection with said projection extending inwardly from said internal wall of said ring portion.

7. The vessel according to claim 6, wherein said cap type sealing tool and said bottle portion are constructed and arranged such that after said cap portion becomes temporarily mounted to said bottle portion, said cap type sealing tool can be removed from said bottle portion so as to feed contents into said bottle portion.

8. The vessel according to claim 2, further comprising a part to limit rotation of said cap portion to at most 15° after breakage of said bridge parts and after a final complete rotation of said cap portion so as to prevent over-fastening of said cap portion to said bottle portion.

9. The vessel according to claim 2, wherein said bottomed cylindrical part of said cap portion includes a top plate part having an internal annular portion extending therefrom slightly inwardly of a peripheral edge of said top plate, and wherein said bottle portion defines an opening at said first end of said cylindrical part of said bottle portion within which is to be pressed said internal annular portion upon rotation of said cap portion so as to achieve airtightness within said bottle portion, with an outer diameter reducing range of said internal annular portion which results from said internal annular portion being pressed into said opening of said bottle portion being up to 0.5 mm when an outer diameter of said internal annular portion is 20 mm.

10. The vessel according to claim 2, wherein said second projection has a length that is 10% to 45% greater than a length of said first projection.

11. The vessel according to claim 2, wherein said bottle portion is constructed and arranged to hold a contact lens therein, and said bottomed second end includes plural projections that are spaced from one another at top portions thereof by 15% to 90% of an outside diameter of the contact lens and have heights that differ from one another by at least 5% of a thickness at a nearly central portion of the contact lens, when the contact lens is held within said bottle portion.

12. The vessel according to claim 1, wherein said plural sliding protrusions centrally extend from said lower portion of said internal wall of said ring portion and each have a shape corresponding to one of a nearly dot-like protrusion and a nearly straight projection, and with portions thereof which contact said upward spread zone having a cross-section that is slightly rounded and is one of nearly triangular, nearly tapered trapezoidal, nearly semicircular and nearly mushroom in shape.

13. The vessel according to claim 1, wherein a gradient of said upward spread zone is from 0.15 to 1.4, and is expressed as the remainder, of an outer diameter of an upper end face of said upward spread zone minus an outer diameter of a lower end face of said upward spread zone, divided by a length of said upward spread zone.

14. The vessel according to claim 1, wherein said cap type sealing tool and said bottle portion are constructed and arranged such that upon rotation of said cap type sealing tool in the closing direction, said cap portion becomes temporarily mounted to said bottle portion when the rotation is stopped upon engagement of said second projection with said projection extending inwardly from said internal wall of said ring portion.

15. The vessel according to claim 14, wherein said cap type sealing tool and said bottle portion are constructed and arranged such that after said cap portion becomes temporarily mounted to said bottle portion, said cap type sealing tool can be removed from said bottle portion so as to feed contents into said bottle portion.

16. The vessel according to claim 1, further comprising a part to limit rotation of said cap portion to at most 15° after breakage of said bridge parts and after a final complete rotation of said cap portion so as to prevent over-fastening of said cap portion to said bottle portion.

17. The vessel according to claim 1, wherein said bottomed cylindrical part of said cap portion includes a top plate part having an internal annular portion extending therefrom slightly inwardly of a peripheral edge of said top plate, and wherein said bottle portion defines an opening at said first end of said cylindrical part of said bottle portion within which is to be pressed said internal annular portion upon rotation of said cap portion so as to achieve airtightness within said bottle portion, with an outer diameter reducing range of said internal annular portion which results from said internal annular portion being pressed into said opening of said bottle portion being up to 0.5 mm when an outer diameter of said internal annular portion is 20 mm.

18. The vessel according to claim 1, wherein said second projection has a length that is 10% to 45% greater than a length of said first projection.

19. The vessel according to claim 1, wherein said bottle portion is constructed and arranged to hold a contact lens therein, and said bottomed second end includes plural projections that are spaced from one another at top portions thereof by 15% to 90% of an outside diameter of the contact lens and have heights that differ from one another by at least 5% of a thickness at a nearly central portion of the contact lens, when the contact lens is held within said bottle portion.

* * * * *